US007021406B2

(12) United States Patent
Zitha

(10) Patent No.: US 7,021,406 B2
(45) Date of Patent: Apr. 4, 2006

(54) METHOD OF DRILLING WITH MAGNETORHEOLOGICAL FLUID

(75) Inventor: Pacelli Lidio Jose Zitha, Delft (NL)

(73) Assignee: Technische Universiteit Delft, Delft (NL)

( * ) Notice: Subject to any disclaimer, the term of this patent is extended or adjusted under 35 U.S.C. 154(b) by 0 days.

(21) Appl. No.: 10/962,354

(22) Filed: Oct. 8, 2004

(65) Prior Publication Data

US 2005/0109540 A1 May 26, 2005

Related U.S. Application Data

(63) Continuation of application No. PCT/NL03/00276, filed on Apr. 10, 2003.

(30) Foreign Application Priority Data

Apr. 10, 2002 (NL) ..... 1020355

(51) Int. Cl.
*C09K 7/00* (2006.01)
*E21B 7/18* (2006.01)

(52) U.S. Cl. ..... 175/72; 175/65; 166/66.5

(58) Field of Classification Search ..... 175/72, 175/48, 38, 57, 65; 166/381, 66.5, 285, 292, 166/248; 507/143, 271
See application file for complete search history.

(56) References Cited

U.S. PATENT DOCUMENTS

| | | | | |
|---|---|---|---|---|
| 3,496,902 | A * | 2/1970 | Kern et al. | 175/72 |
| 4,222,444 | A | 9/1980 | Hamilton | |
| 4,579,173 | A | 4/1986 | Rosensweig et al. | |
| 4,802,534 | A | 2/1989 | Larson et al. | |
| 2005/0028522 | A1 * | 2/2005 | Fripp et al. | 60/533 |

FOREIGN PATENT DOCUMENTS

| | | |
|---|---|---|
| GB | 1 265 708 | 3/1972 |
| RU | 2079646 C1 | 5/1997 |

* cited by examiner

*Primary Examiner*—David Bagnell
*Assistant Examiner*—Daniel P Stephenson
(74) *Attorney, Agent, or Firm*—Jeffrey D. Myers; Peacock Myers, P.C.

(57) ABSTRACT

A method of drilling a bore hole into a stratum, wherein via the drill hole drilling fluid is introduced and fed to the drill head. In order to avoid dilution or leak-off of the drilling fluid the same is in accordance with the invention a magnetorheological drilling fluid, and when an undesirable pressure difference occurs between the drilling fluid at the height of the drill head and a fluid present in the stratum surrounding the drill head, a magnetic field is applied. The inventions also provide a permanent solution.

7 Claims, 2 Drawing Sheets

METHOD OF DRILLING WITH MAGNETORHEOLOGICAL FLUID

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

FIELD OF THE INVENTION

1. Technical Field

The present invention relates to a method of drilling a bore hole into a stratum, using a drill head connected to a drilling rod, wherein via the drill hole drilling fluid is introduced and fed to the drill head.

2. Description of Related Art

Such a method is generally known. The drilling fluid serves, among other things, for cooling the drill head, for flushing out rocks loosened by drilling and for limiting the friction between the drilling rod and the wall of the drilled hole.

One problem is that depending on the local pressure at the drill head 5, the drilling fluid 1 leaks away via fractures 6, or the drilling fluid 1 is diluted by water from a water-bearing stratum 7. This is, of course, undesirable. This problem is aggravated because the temperature over the length of the drill hole changes considerably and consequently also the viscosity of the drilling fluid.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
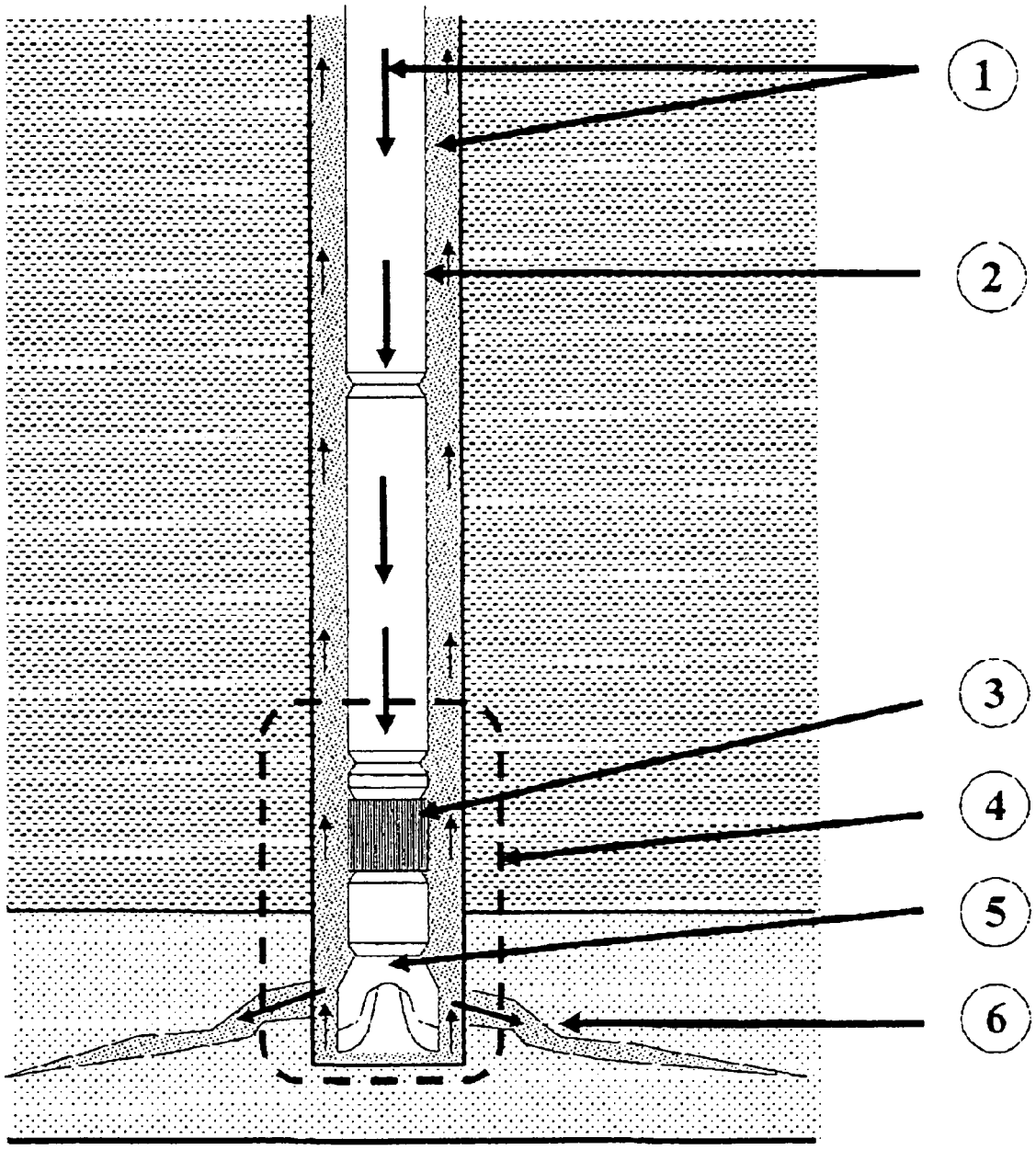
FIG. 1 is a cut-away view depicting circulation of drilling mud which passes through rods and out of a drill head some of mud is depicted as entering into a formation.
Figure 2:
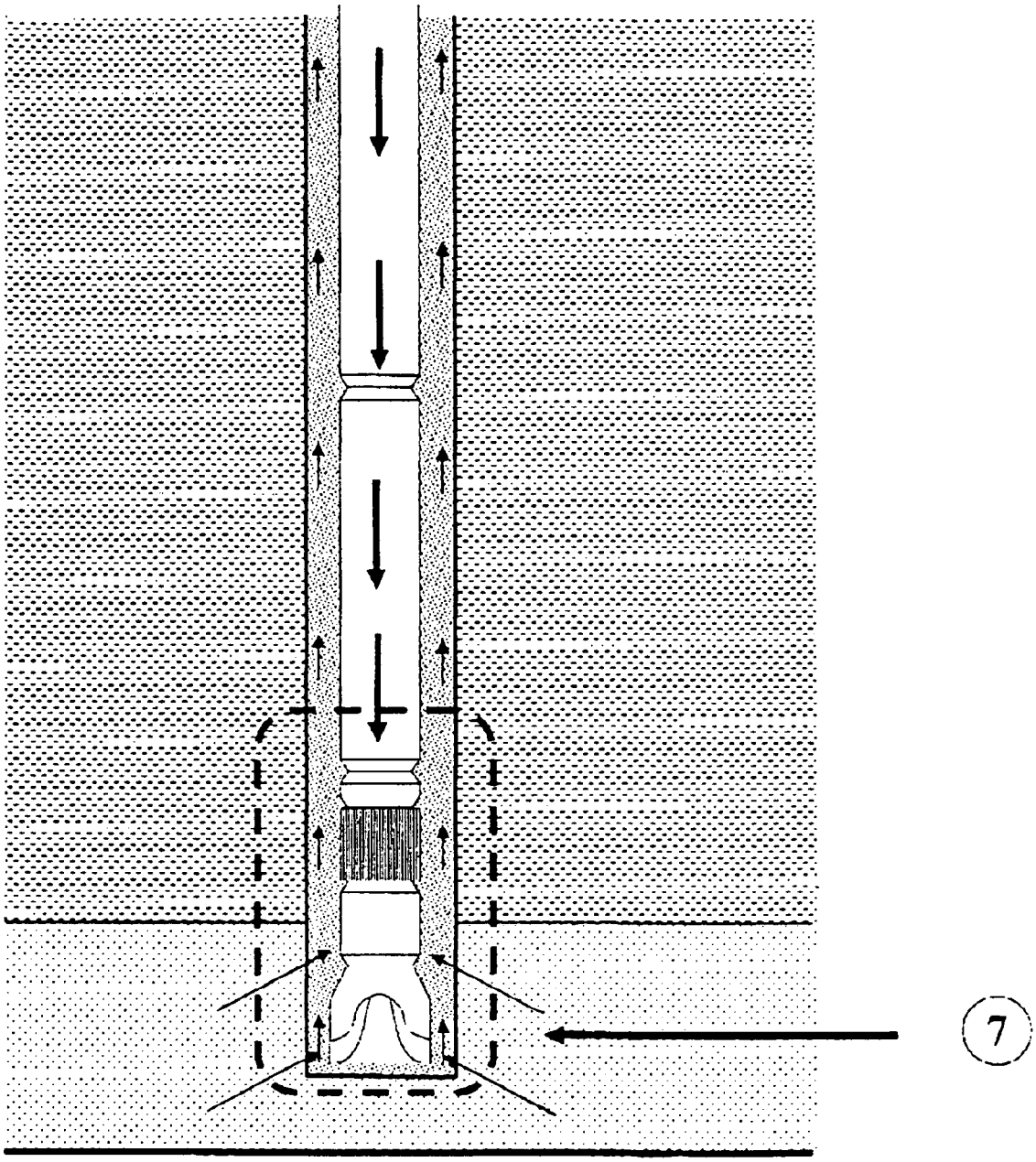
FIG. 2 is a cut-away view depicting circulation of drill mud which passes through rods and out of drill head before reservoir fluids mix therewith and travel toward a surface.

It is the object of the present invention to provide a method with which the problem can be effectively solved.

To this end a method is provided in accordance with the preamble, which is characterized in that the drilling fluid that is introduced is a magnetorheological drilling fluid and when an undesirable pressure difference occurs between i) the drilling fluid at the height of the drill head and ii) a fluid present in the stratum surrounding the drill head, a magnetic field is applied 3.

This makes it possible to instantaneously, and more quickly than was possible up till now, increase the viscosity of the drilling fluid so as to drastically reduce dilution or leakoff. A possibility is to change over to another drilling fluid. The magnetic component may be any magnetic component, such as a paramagnetic component and preferably a ferromagnetic component. It will be clear to the person not skilled in the art that the amount of magnetic component can be varied within a wide range, depending on the increase in viscosity expected to be necessary. If this is largely unknown, it is advisable in order to be on the safe side, to ensure that a high-content of magnetic component is present. At least 80% of the particles of the particulate component have a size from between 0.0005 to 5 mm, preferably between 0.005 and 0.5 mm. In order to influence the flow behaviour, it is essential for the particles to be able to interact sufficiently (cohesion/adhesion) with the surrounding fluid. The viscosity should be increased at least 3-fold and preferably at least 5-fold at the chosen field intensity. Optionally the particles may be provided with a coating, or be incorporated in a larger object such as a sphere. Should the occasion arise, a coating can also protect the particles against oxidation or acidic compounds in the earth. In this way even a limited amount of the magnetic component itself can have a strong effect on the drilling fluid, which may be favourable in respect of costs. The magnetic field applied will usually have an intensity of at least 0.01 Tesla, and preferably at least 0.05, such as 0.05 to 0.5 Tesla. In addition to the known magnetorheological fluids there are also ferrofluids. In a ferrofluid each magnetic particle (of, for example, 15 nm) is an individual domain. Ferrofluids can not be used in the present invention because the application of a magnetic field does not or only slightly increase the viscosity. It should be noted that when such individual domain particles are clustered to larger particles, for example, by incorporation in colloidal silica, particles are formed comprising more domains, and are thus able to impart magnetorheological properties to the fluid. These are useful for the invention.

In a more permanent solution according to an important preferred embodiment, a sealing agent can be fed to the drill head.

In this way dilution or leakoff can be avoided by blocking up the fractures, pores etc. 4 that cause the problem.

Preferably the sealing agent is supplied in a container having a diameter smaller than the smallest inside diameter of the drilling rod 2.

This allows the sealing agent to reach the drill head through the drilling rod without itself being diluted. It is also easy to control the desired amount on the basis of the number of containers.

Preferably the container has a wall formed like a film.

Such a film-like wall is easy to fabricate and may itself also contribute to the sealing of fractures.

The container may be sealed by means of a low-melting material, for example, a wax, or may be fabricated from a low-melting material. However, according to a preferred embodiment, the container is broken by the drill head, thereby releasing the sealing agent.

In this way the delivery of the contents of the container to the desired location can be ensured.

The sealing agent may be of the most diverse forms. These may include a monomer or pre-polymer that is polymerised. It is possible to add an initiator, optionally in a separate container.

However, according to a first embodiment the sealing agent comprises a cross-linkable polymer.

Such cross-linkable polymers are known in the art of oil winning and require no further explanation. The person not skilled in the art might consult, for example, the article "Water control" by Bailey, W. et al (Oilfield Review, Spring, pp. 30–51 (2000)).

According to a second embodiment the sealing agent comprises cement.

Cement, which includes concrete, can be prepared simply on site, may be packed in film-like sachet or tubes, which are preferably heat-sealable.

The material used for preparing the magnetorheological drilling fluid is preferably ground magnetite, which is very cheap.

In the method described above, the drilling rods unction as supply pipe for the drilling fluid. The method according to the invention is also thought to be suitable for solving the above-described problem that occurs when constructing drilled tunnels. In such a case there are no drilling rods for the supply of drilling fluid, but the containers with the sealing agent can be supplied to the desired location via the usual supply pipes for drilling fluid or also via other (sealable) openings provided in the drill head.

What is claimed is:

1. A method of drilling a bore hole into a stratum, using a drill head connected to a drilling rod, wherein via the drill hole drilling fluid is introduced and fed to the drill head, wherein the drilling fluid that is introduced is a magnetorheological drilling fluid and when the undesirable pressure difference occurs between the drilling fluid at the height of the drill head and a fluid present in the stratum surrounding the drill head, a magnetic field is applied.

2. A method according to claim 1, wherein a sealing agent is fed to the drill head.

3. A method according to claim 2, wherein the sealing agent comprises a cross-linkable polymer.

4. A method according to claim 2, wherein the sealing agent comprises cement.

5. A method according to claim 2, wherein the sealing agent is supplied in a container having a diameter smaller than the smallest inside diameter of the drilling rod.

6. A method according to claim 2, wherein the container has a wall formed like a film.

7. A method according to claim 2, wherein the container is broken by the drill head, thereby releasing the sealing agent.

* * * * *